US010470539B2

(12) United States Patent
Tebo et al.

(10) Patent No.: US 10,470,539 B2
(45) Date of Patent: Nov. 12, 2019

(54) CASE FOR PORTABLE ELECTRONIC DEVICE

(71) Applicants: Glenn J. Tebo, Kingston, NH (US); Owen G. Tebo, Kingston, NH (US)

(72) Inventors: Glenn J. Tebo, Kingston, NH (US); Owen G. Tebo, Kingston, NH (US)

( * ) Notice: Subject to any disclaimer, the term of this patent is extended or adjusted under 35 U.S.C. 154(b) by 185 days.

(21) Appl. No.: 14/936,133

(22) Filed: Nov. 9, 2015

(65) Prior Publication Data

US 2016/0058144 A1 Mar. 3, 2016

Related U.S. Application Data

(63) Continuation of application No. PCT/US2014/037100, filed on May 7, 2014.

(60) Provisional application No. 61/822,059, filed on May 10, 2013.

(51) Int. Cl.

| | |
|---|---|
| ***A45C 11/00*** | (2006.01) |
| ***B65H 75/40*** | (2006.01) |
| ***B65H 75/44*** | (2006.01) |
| ***H04R 1/10*** | (2006.01) |
| ***A45C 13/02*** | (2006.01) |

(52) U.S. Cl.

CPC ..... *A45C 11/00* (2013.01); *A45C 13/02* (2013.01); *B65H 75/406* (2013.01); *B65H 75/4471* (2013.01); *H04R 1/1033* (2013.01); *A45C 2011/002* (2013.01); *A45C 2013/025* (2013.01); *B65H 2701/3919* (2013.01)

(58) Field of Classification Search

CPC ... A45C 11/00; A45C 13/02; A45C 2011/002; A45C 2013/025; B65H 75/406; B65H 75/4471; H04R 1/1033

USPC ..... 206/38

See application file for complete search history.

(56) References Cited

U.S. PATENT DOCUMENTS

| | | | |
|---|---|---|---|
| 5,706,353 | A | 1/1998 | Arai et al. |
| 6,845,158 | B2 | 1/2005 | Koester et al. |
| 7,086,512 | B2 | 8/2006 | Shack et al. |
| 7,599,509 | B2 | 10/2009 | Ito |

(Continued)

OTHER PUBLICATIONS

International Search Report and Written Opinion dated Sep. 3, 2014 in corresponding PCT Patent Application No. PCT/US14/037100.

*Primary Examiner* — Anthony D Stashick
*Assistant Examiner* — James M Van Buskirk
(74) *Attorney, Agent, or Firm* — Grossman, Tucker, Perreault & Pfleger, PLLC

(57) ABSTRACT

A case for a portable electronic device configured to provide protection for the electronic device and further provide storage for one or more corded-accessories for use with the electronic device, including, but not limited to, headphones. The electronic device case includes a case member configured to cover at least a portion of an electronic device and a spool member configured to retain a pair of headphones. The case member includes a cavity configured to receive the spool member and one or more channels in fluid communication with the cavity configured to receive portions of headphone cord. The case member further includes recesses in fluid communication with the one or more channels and configured to receive and retain the headphone earphones within. The case member further includes a means of releasably retaining the spool member within the cavity of the case member.

16 Claims, 12 Drawing Sheets

(56) References Cited

U.S. PATENT DOCUMENTS

| | | | | |
|---|---|---|---|---|
| 7,822,448 | B2 | 10/2010 | Lin et al. | |
| 8,290,547 | B2 | 10/2012 | Cataldo et al. | |
| 8,336,688 | B2 | 12/2012 | Chen et al. | |
| 8,365,887 | B2 | 2/2013 | Fischer | |
| 8,560,031 | B2 | 10/2013 | Barnett et al. | |
| 2005/0255898 | A1 | 11/2005 | Huang | |
| 2007/0023559 | A1 | 2/2007 | Scapillato et al. | |
| 2008/0080732 | A1 | 4/2008 | Sneed | |
| 2011/0203954 | A1 | 8/2011 | Kroupa | |
| 2011/0233078 | A1 | 9/2011 | Monaco et al. | |
| 2012/0128193 | A1 | 5/2012 | Stevinson | |
| 2012/0138725 | A1 | 6/2012 | Chen et al. | |
| 2012/0153065 | A1 | 6/2012 | Fischer | |
| 2012/0224737 | A1 | 9/2012 | Cataldo et al. | |
| 2013/0020425 | A1 | 1/2013 | Grassi et al. | |
| 2013/0083456 | A1 | 4/2013 | Koenig et al. | |
| 2013/0208937 | A1* | 8/2013 | Stern | H04M 1/04 381/332 |
| 2013/0265702 | A1* | 10/2013 | Merenda | B65H 75/48 361/679.01 |

* cited by examiner

CASE FOR PORTABLE ELECTRONIC DEVICE

CROSS-REFERENCE TO RELATED APPLICATIONS

This application is a continuation of International Patent Application No. PCT/US2014/37100, filed May 7, 2014, designating the U.S. and claiming the benefit of U.S. Provisional Patent Application Ser. No. 61/822,059, filed May 10, 2013, the entire disclosures of which are incorporated herein by reference.

FIELD

The present disclosure relates generally to cases for portable electronic devices, and, more particularly, to a case for housing a portable electronic device, such as a smartphone, as well as additional accessories associated with the portable electronic device, such as earphones.

BACKGROUND

Current portable electronic devices, such as, for example, smartphones and media players, provide a variety of means for audio playback to the user. For example, some devices include integrated speakers. In addition, or alternatively to, many portable electronic devices generally include audio output jack(s) for allowing a user to receive audio playback by way of headphones (also referred to herein as "earphones") coupled to the audio output jack(s). Accordingly, a user may have a telephone conversation or listen to music by way of headphones coupled to the portable electronic device.

The use of headphones with portable electronic devices may provide numerous benefits and convenience. For example, during an active phone call, headphones may protect the user from radio emissions and, in the event the user is engaged in an activity, such as operating a motor vehicle, headphones further allow the user to drive safely by precluding the need to hold the electronic device to the user's ear while using the electronic device. Similarly, when listening to music, watching a video or playing a game, headphones may generally provide a user with improved audio quality and a sense of privacy.

The use of headphones with portable electronic devices may be cumbersome and a form of frustration for some users, as described in greater detail herein. As generally understood, headphones include a cable portion having a plug at one end (for insertion into female audio jack of the device) and earphones or earbuds (for in-ear type headphone) at the other end. A predetermined length of the cable may not always be optimal or ideal for all users. In some cases, for example, the cable may be much longer than required by a user, and, as such, the user may attempt to manually reduce the length of the cable by winding some portion of the cable around the electronic device. However, winding of the cable around the electronic device may create stress on wires inside the cable and lead to damage. Additionally, the wound cable may interfere with the user's ability to interact with the device.

In addition, when the headphones are not in use and are disconnected from the device, storage of the headphones may be an issue. For example, a user may store the headphones in their pocket or purse or, if in a vehicle, a user may place the headphones in a cup holder or storage bin(s) in the center console or side door of the vehicle. However, the headphones may be loosely stored, such that the cable may become entangled upon itself. As such, in the event that the user wishes to use the headphones, the user is required to manually untangle the headphones, which can be inconvenient and, in certain situations, may be dangerous and pose a serious risk to the user's safety (e.g. if the user attempts to untangle the headphones while operating a motor vehicle). Accordingly, the storage and management of headphones, as well as other cable-based accessories, for a portable electronic device can be tedious and frustrating for a user.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

Figure 1:
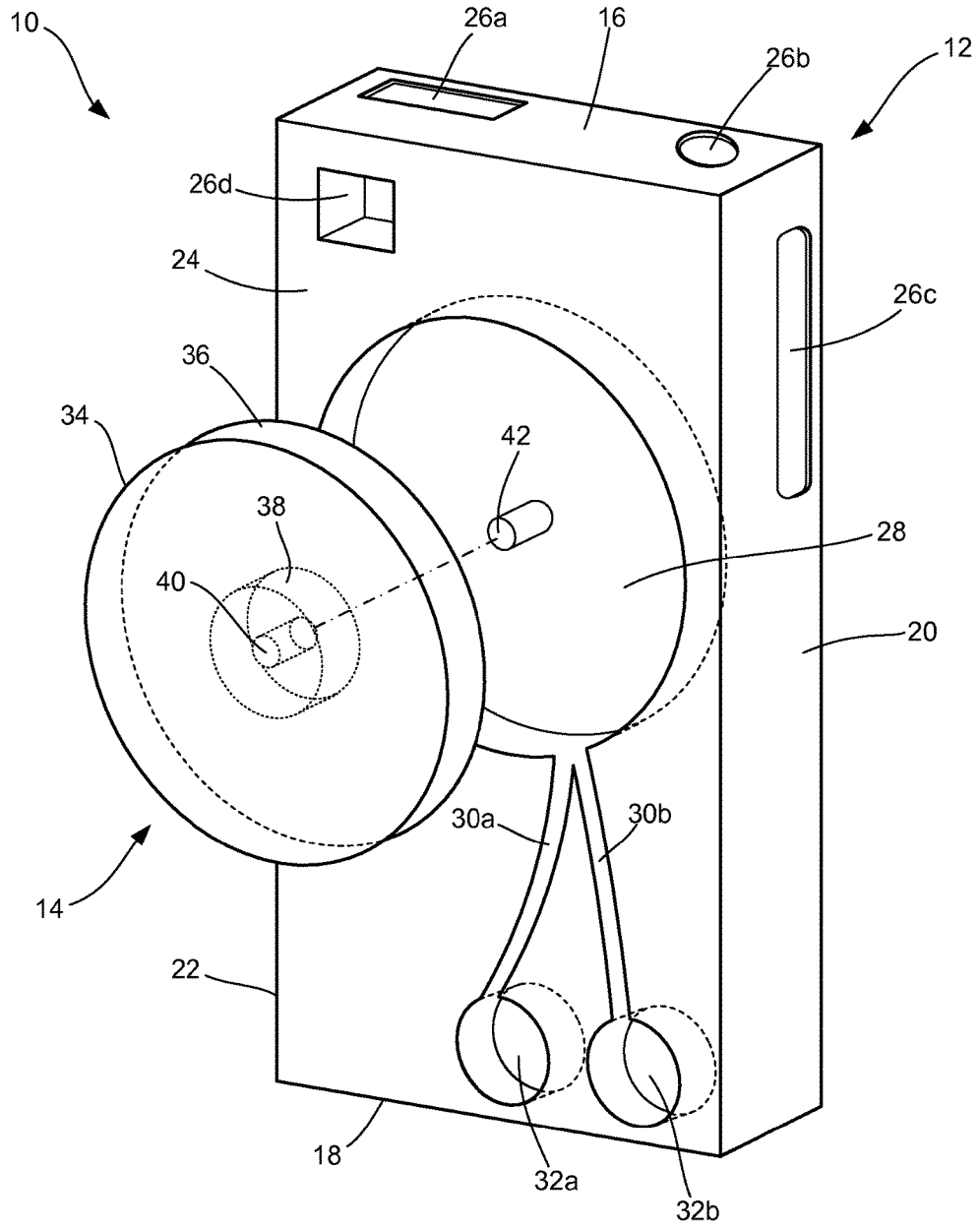
FIG. 1 is a rear perspective view of an electronic device case consistent with the present disclosure illustrating the spool member separated from the case member.

The present disclosure is generally directed to a case for a portable electronic device configured to provide protection for the electronic device and further provide storage for one or more corded-accessories for use with the electronic device, including, but not limited to, headphones. The electronic device case includes a case member configured to cover at least a portion of an electronic device and a spool member configured to retain a corded-accessory, such as, for example, a pair of headphones, for use with the electronic device. The spool member includes first and second flange members coupled to one another by a hub disposed therebetween around which headphones may be wound. The case member includes a front cavity shaped and/or sized to receive a portion of the electronic device within and a rear cavity shaped and/or sized to receive the spool member within.

The case member further includes one or more channels defined on a rear portion thereof and in fluid communication with the rear cavity. The one or more channels are configured to receive one or more portions of cord of the headphones when the spool member is loaded (i.e. when the headphones are wound around the spool member) and positioned within the rear cavity. The case member further includes recesses defined on the rear portion and in fluid communication with the one or more channels, the recesses being shaped and/or sized to receive and store earphones within. The case member further includes a channel extending between the rear cavity and the front cavity, such that a portion of headphone cord and plug attached thereto may extend from the loaded spool member into the front cavity and be positioned so as to be received within a female audio jack of the electronic device. The electronic device case may further include a means of retaining the spool member within the rear cavity of the case member.

An electronic device case consistent with the present disclosure provides protection for an electronic device while further providing a means for storing cable accessories for use with the electronic device, specifically storage and management of headphones. The spool member for storing and managing the headphones is configured to be directly integrated with the case member of the electronic device case, thereby further providing a user with access to the headphones at all times without resulting in an overly bulky case and/or hindering the user's ability to interact with the electronic device.

When a user is not in immediate need of the headphones, the spool member, in conjunction with the case member, allows the user to store the headphones in an organized and readily accessible manner. For example, the spool member is relatively simple in design and allows a user to manually wind the headphone cord around the spool and the recesses defined on the rear portion of the case member provide storage for the earphones. The spool member further promotes tangle-free storage the headphones.

Similarly, when a user needs to use the headphones, the headphones are readily accessible for use. Additionally, manual winding of the spool member allows a user to determine the desired length of cord for any particular application. For example, when using a digital audio player, the user may wish to have only a portion of the headphones freely available for use, and to have the remaining portions of the headphones disposed in an organized and readily available fashion. The spool member is configured to limit slack in a cord portion, such that the cord may be less likely to be snagged, which may lead to injury to the device, the user, or otherwise.

Figure 2:
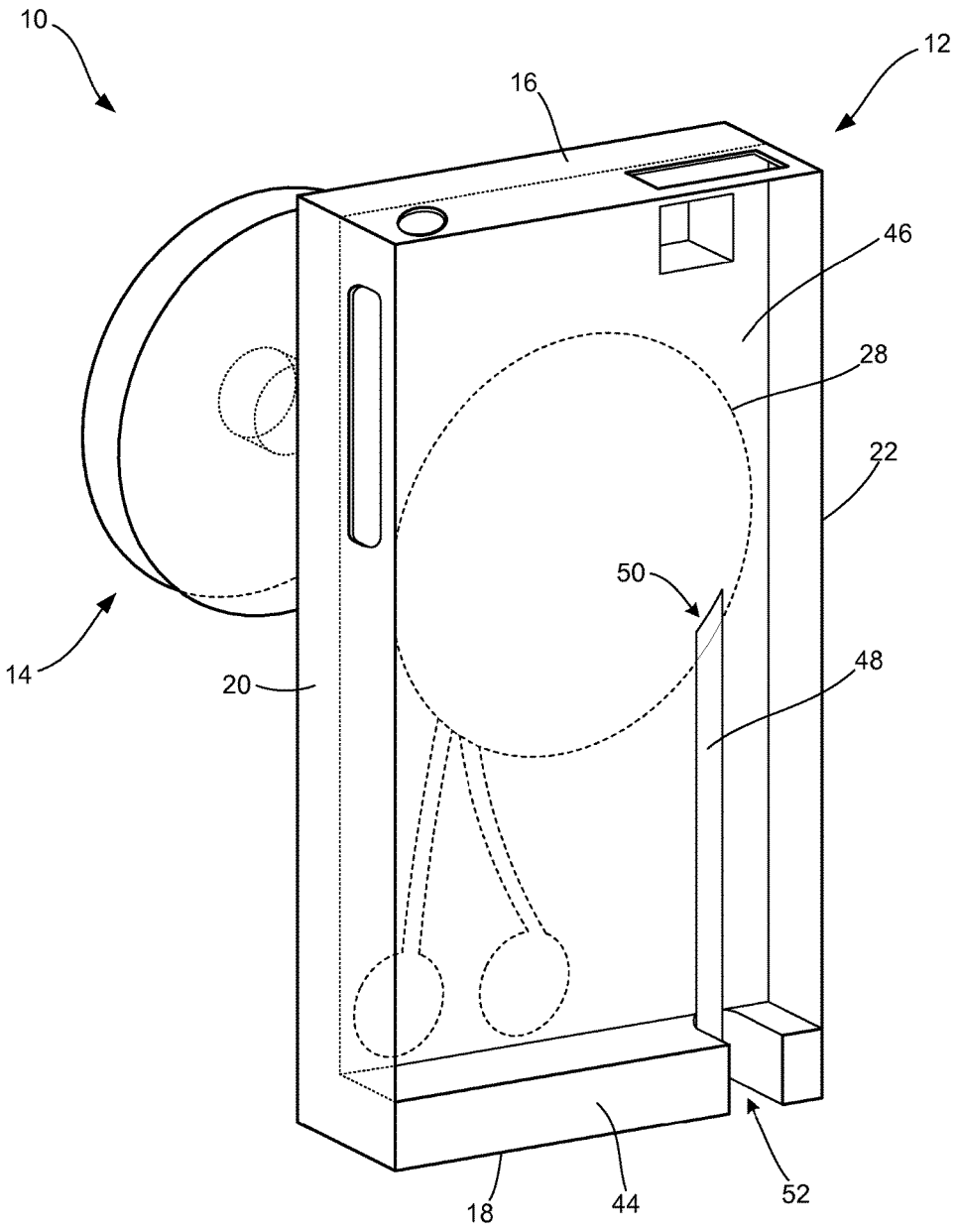
FIG. 2 is a front perspective view of the electronic device case of FIG. 1 illustrating the spool member separated from the case member.

Turning to FIG. 1, a rear perspective view of an electronic device case 10 consistent with the present disclosure is illustrated and FIG. 2 is a front perspective view of the electronic device case 10 of FIG. 1. The electronic device case 10 includes a case member 12 and a spool member 14 configured to be coupled to the case member 12. As shown in FIGS. 1 and 2, the spool member 14 is shown separated from the case member 12 for ease of description. It should be noted that internal features and/or surfaces are illustrated in phantom.

The case member 12 includes a top portion 16, bottom portion 18 and side portions 20, 22. The case member 12 further includes a front portion (shown in FIG. 2) and a rear portion 24. The case member 12 may further include one or more openings 26*a*-26*d* defined on one or more of the top, bottom, side and/or rear portions for providing a user with access to corresponding inputs and/or components on the electronic device when the electronic device is covered by the case member 12. For example, openings 26*a* and 26*b* may be defined on the top portion 16 of the case member 12 and may correspond to the power button and female audio jack of an electronic device. Opening 26*c* may be defined on side portion 20 and may correspond to volume inputs of the electronic device and opening 26*d* may be defined on the rear portion 24 and may correspond to a camera of the electronic device. It should be noted that a case member 12 consistent with the present disclosure may include a variety of different openings for providing access to corresponding inputs/components of a variety of different electronic devices, and, as such, should not be limited to those depicted in the figures herein.

The case member 12 further includes a rear cavity 28 defined on the rear portion 24. The rear cavity 28 is shaped and/or sized to receive the spool member 14 within. The case member 12 further includes channels 30*a*, 30*b* defined on the rear portion 24, wherein the channels 30*a*, 30*b* extend from and are in fluid communication with a portion of the rear cavity 28. The channels 30*a*, 30*b* extend along the rear portion 24 of the case member 12 and terminate at associated recesses 32*a*, 32*b*. As described in greater detail herein, the channels 30*a*, 30*b* are shaped and/or sized to receive portions of a headphone cord loaded (e.g. wound) onto the spool member 14 and the recesses 32*a*, 32*b* are shaped and/or sized to receive earbuds coupled to ends of the headphone cords.

Although shown as being defined on the rear portion 24 of the case member 12, it should be noted that a cavity for receiving the spool 12 may be defined on other portions of the case member 12, such as the top 16, bottom 18, sides 20, 22 or combinations thereof.

In the illustrated embodiment, the spool member 14 includes a first flange 34 and a second flange 36 coupled to one another by way of a hub 38 positioned therebetween, wherein the hub 38 includes a bore 40 defined therein. The bore 40 may extend entirely through at least the second flange 36 and the hub 38. The bore 38 is shaped and/or sized to receive a protrusion 42 extending from within the rear cavity 28 of the case member 12. As shown, the protrusion 42 may be centrally located within the rear cavity 28 such that the protrusion 42 may provide a means of aligning the spool member 14 with the rear cavity 28 when placing the spool member 14 within the rear cavity 28. Although shown as generally round, the spool 14 can take a variety of shapes, including, but not limited to, square, oblong, oval, triangle, etc.

Referring to FIG. 2, the case member 12 further includes a front portion 44 defined on a portion thereof. As shown, the case member 12 further includes a front cavity 46 defined by the top, bottom, side, and front portions. The front cavity 46 is shaped and/or sized to receive an electronic device within. As generally understood, the front cavity 46 may generally be configured to retain the electronic device by any known means, including, but not limited to, press fit.

As shown, a channel 48 may be defined within the front cavity 46. The channel 48 generally extends from and is in fluid communication with a portion of the rear cavity 28, as indicated by arrow 50. The channel 48 extends along a length of the front cavity 46 towards the bottom portion 18 of the case member 12 and is in fluid communication with an opening 52 defined on the bottom and front portions 18, 44. As described in greater detail herein, the channel 48 is shaped and/or sized to receive a portion of the headphone cord having a plug attached thereto. The opening 52 is shaped and/or sized to receive and retain the headphone plug in a position so as to be received within a female audio jack of the electronic device. More specifically, in the illustrated embodiment, the opening 52 corresponds to a female audio jack of the electronic device to be received within the front cavity 46 of the case member 12. However, it should be noted that the opening can be defined on other portions of the case member 12 so as to correspond to a female audio jack of a different electronic device. For example, some electronic devices have an audio jack on a top portion. As such, the opening 52 may be defined on the top portion 16 of the case member 12 and, as such, the channel 48 may extend towards to the top portion 16 and terminate at the opening 52.

The case member 12 and spool member 14 may be composed of a resilient and durable material configured to provide protection for the electronic device and accessories. For example, the case and/or spool member 12, 14 may include plastic, metal, wood, rubber, composites, fiberglass, or a combination of any.

Figure 3:
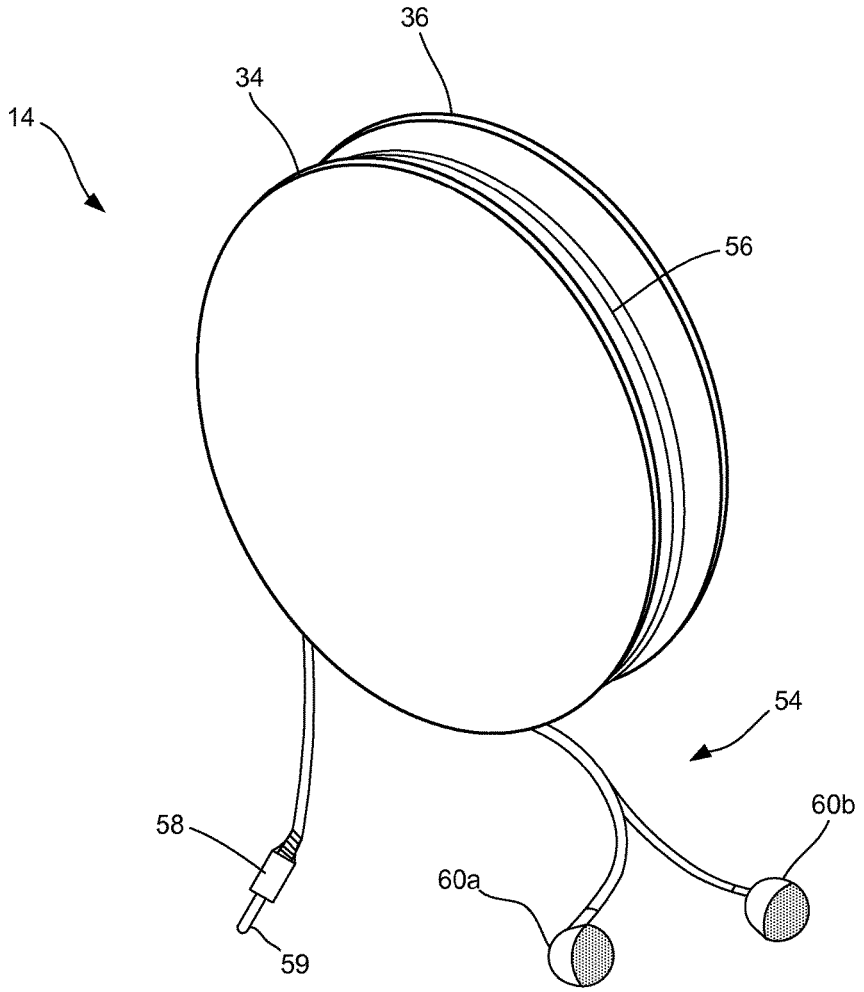
FIG. 3 is a perspective view of an exemplary embodiment of a spool member of the electronic device case of FIG. 1 illustrating earphones wound around the spool member.

FIG. 3 is a perspective view of an exemplary embodiment of a spool member 14 of the electronic device case 10 of FIG. 1. As shown, the spool member 14 is configured to provide storage and management for earphones 54. The earphones generally include a cord 56 having a plug 58 including a conductor tip 59 at one end and earbuds 60*a*, 60*b* at an opposing end (as shown, the cord 56 splits into two separate cords attached to associated earbuds 60*a*, 60*b*). A user may manually wind the earphone cord 56 around the hub of the spool member 14 and between the first and second flanges 34, 36. As shown, the cord 56 may be wound such that a desired length of the plug 58 and the earbuds 60*a*, 60*b* are available.

Figure 4:
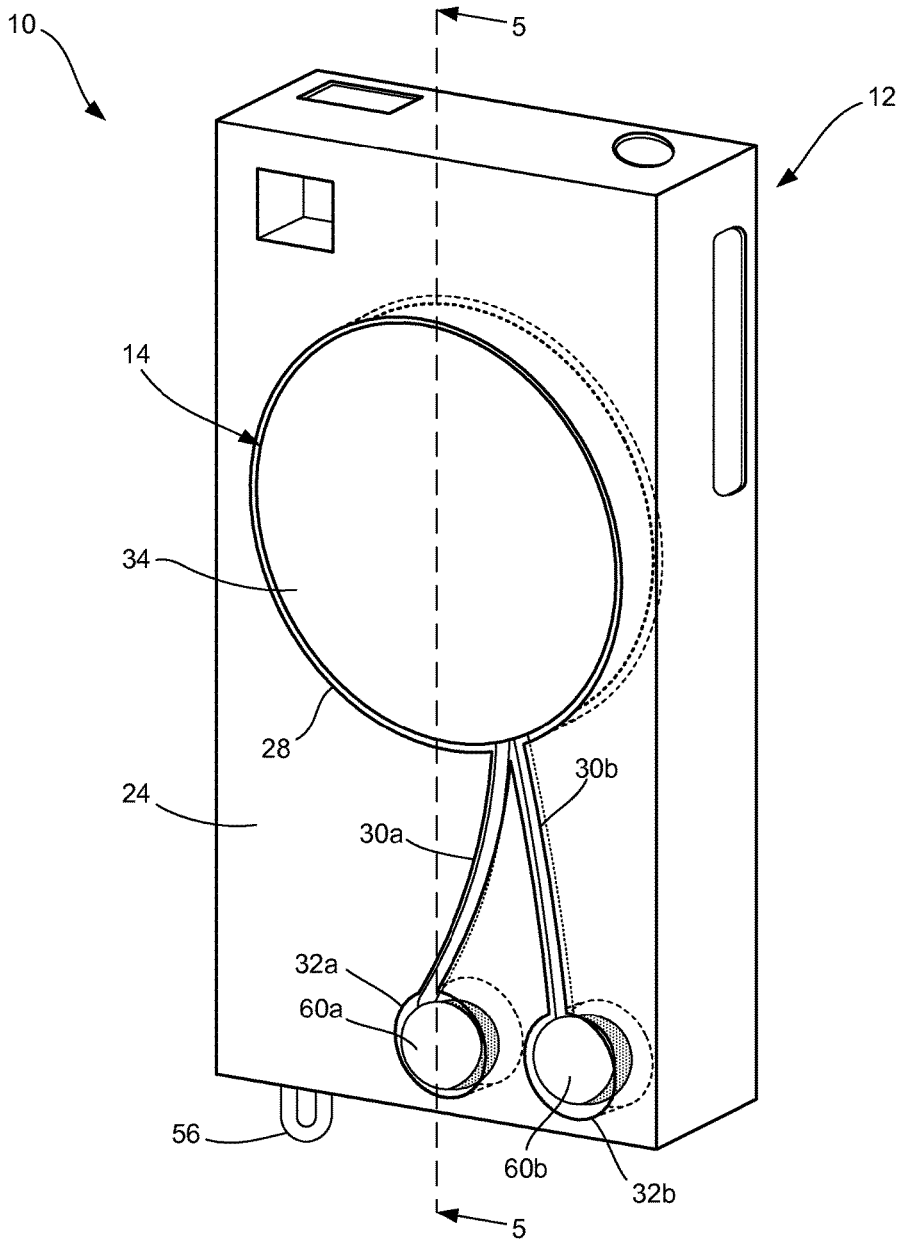
FIG. 4 is a rear perspective view of an electronic device case consistent with the present disclosure in an assembled state including earphones wound around the spool member and coupled to the case member.
Figure 5:
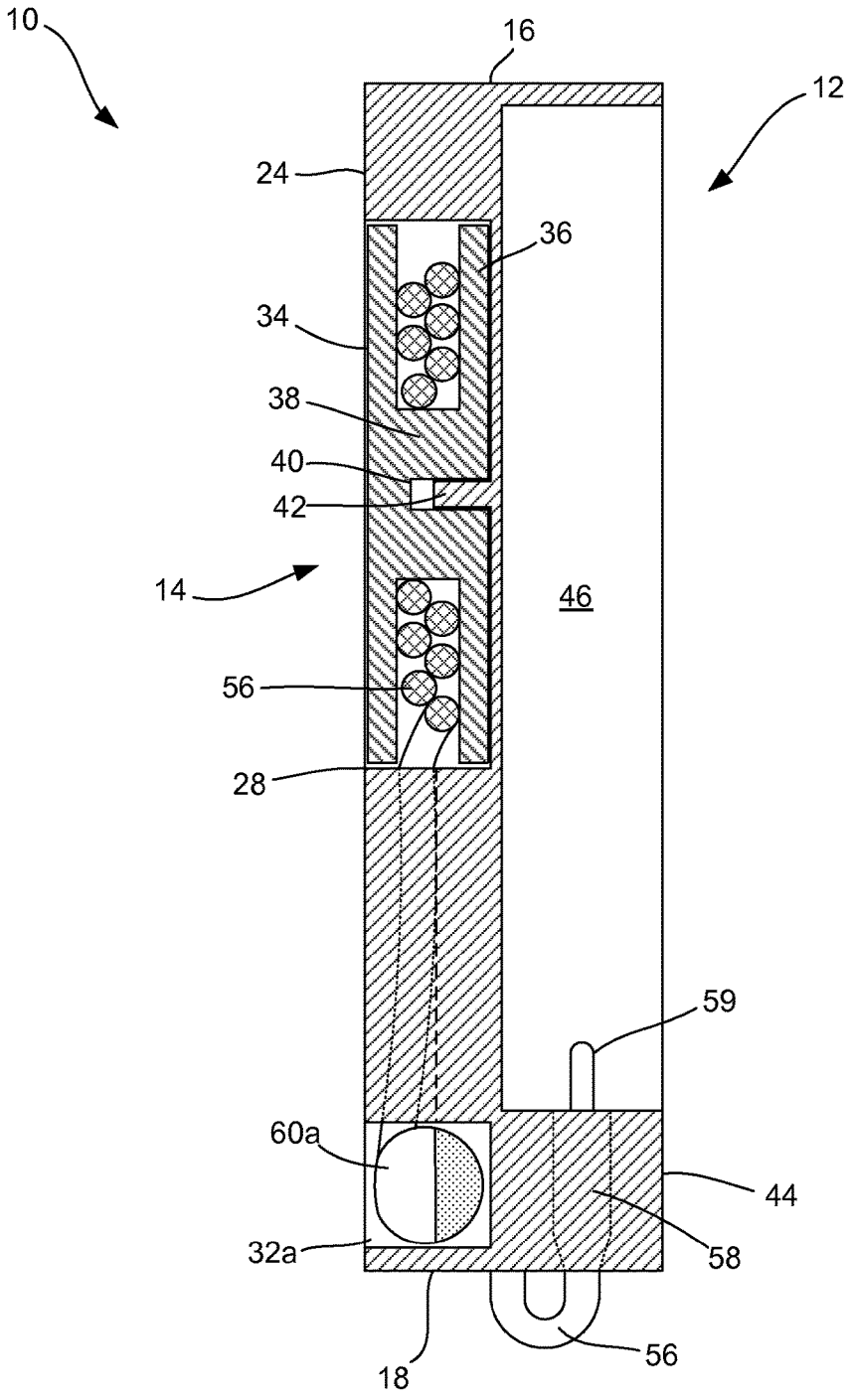
FIG. 5 is a sectional view of the electronic device case of FIG. 4 taken along line 5-5.

FIG. 4 is a rear perspective view of the electronic device case 10 in an assembled state (e.g. the spool member 14 is positioned within the rear cavity 28 of the case member 12) and FIG. 5 is a sectional view of the electronic device case of FIG. 4 taken along line 5-5. As shown, the spool member 14 is loaded (e.g. earphones 54 are wound around the hub 38 and between the first and second flange members 34, 36) and positioned within the rear cavity 28 of the case member 12 such that the first flange member 34 and the rear portion 24 of the case member 12 form a substantially planar surface. In particular, the general shape and geometry of the rear cavity 28 is configured to fully receive the spool member 14 such that the spool member 14 is integrated with the case member 12, resulting in a surface along the rear portion 24 that is relatively uninterrupted.

As shown, portions of the headphone cord 56 may extend from the spool member 14. In particular, the portions of cord coupled to the earphones 60*a*, 60*b* may be positioned within the associated channels 30*a*, 30*b* defined along the rear portion 24 of the case member 12 and the earphones 60*a*, 60*b* may be received and stored within the associated recesses 32*a*, 32*b*. As generally understood, the earphones may be stored within the recesses 32*a*, 32*b* when the headphones are not in use, but may allow a user to quickly access the earphones when desired.

Figure 6:
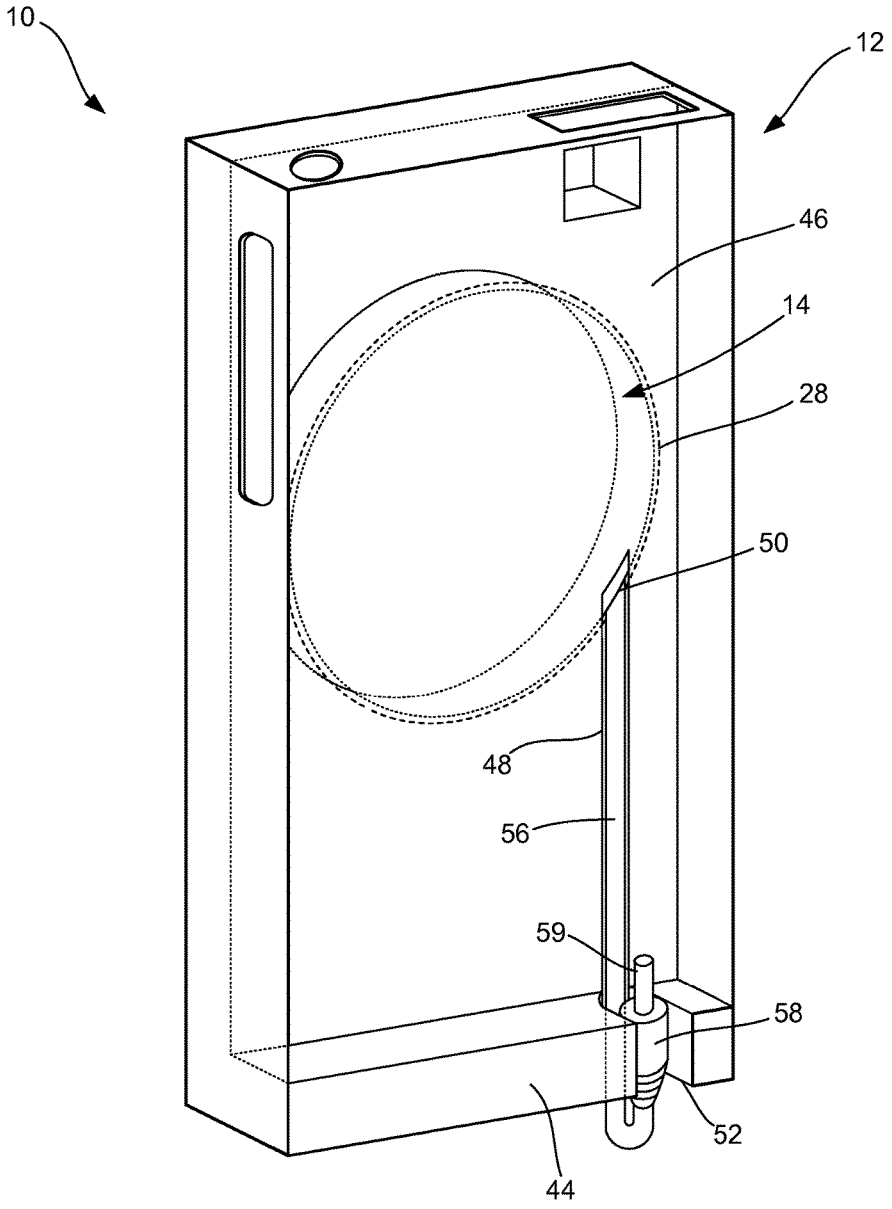
FIG. 6 is a front perspective view of the electronic device case of FIG. 4.

Furthermore, another portion of the cord coupled to the plug 58 may extend from the spool member 14. As shown, specifically in FIG. 6 (which illustrates a front perspective view of the electronic device case 10 of FIG. 4), a portion of the cord 56 may extend from the rear cavity 28 to the front cavity 46, as indicated by arrow 50. The cord may lie within the channel 48 defined in the front cavity 46 and further extend towards the bottom portion 18 of the case member 12. The plug 58 may be positioned within the opening 52 defined on the bottom and front portions 18, 44 of the case member 12, such that the plug 58, specifically the conductor tip 59, may be received within a female audio jack of the electronic device.

Figure 7:
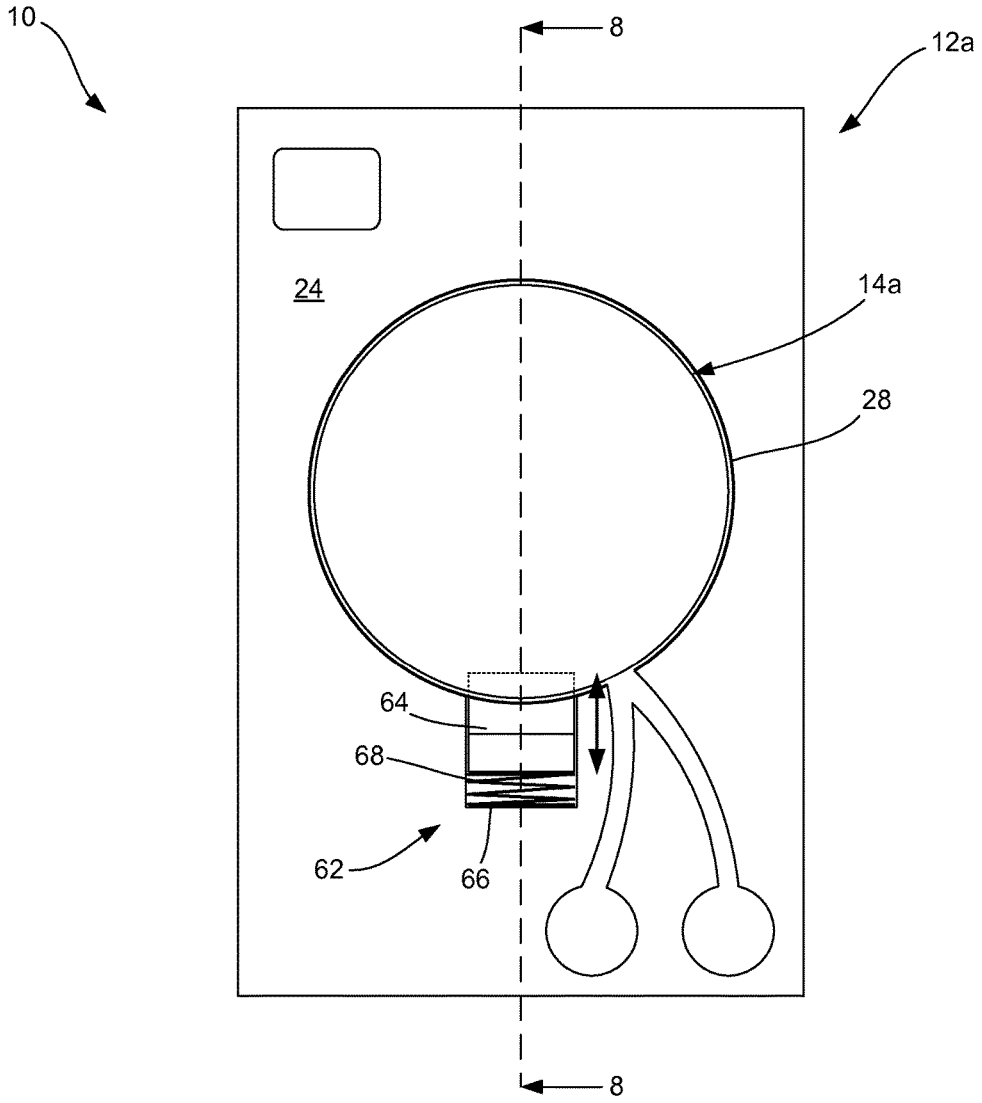
FIG. 7 is a rear view of an electronic device case in an assembled state including one embodiment of a means for coupling and retaining the spool member to the case member consistent with the present disclosure.
Figure 8A:
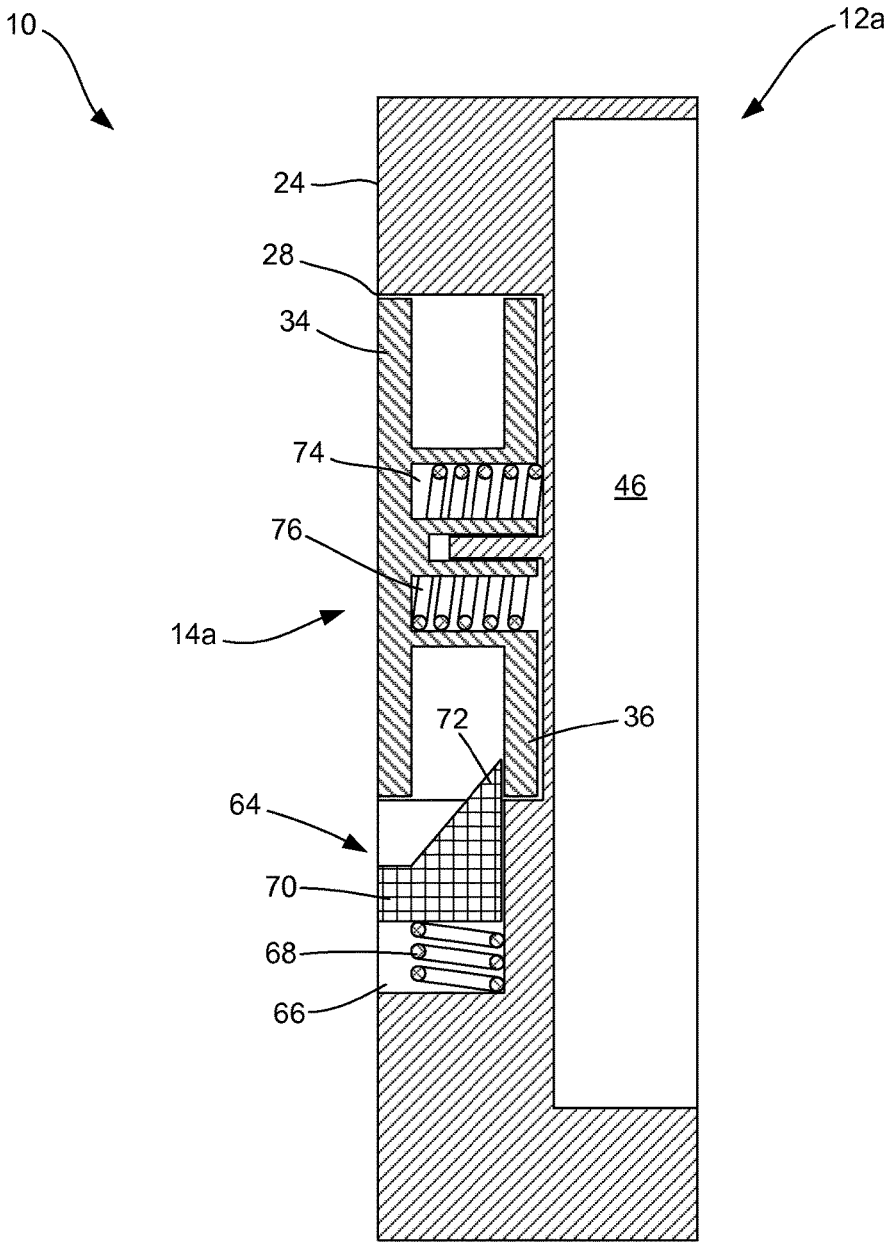
FIGS. 8A and 8B are sectional views of the electronic device case of FIG. 7 taken along line 8-8 illustrating assembled and disassembled states, respectively.
Figure 8B:
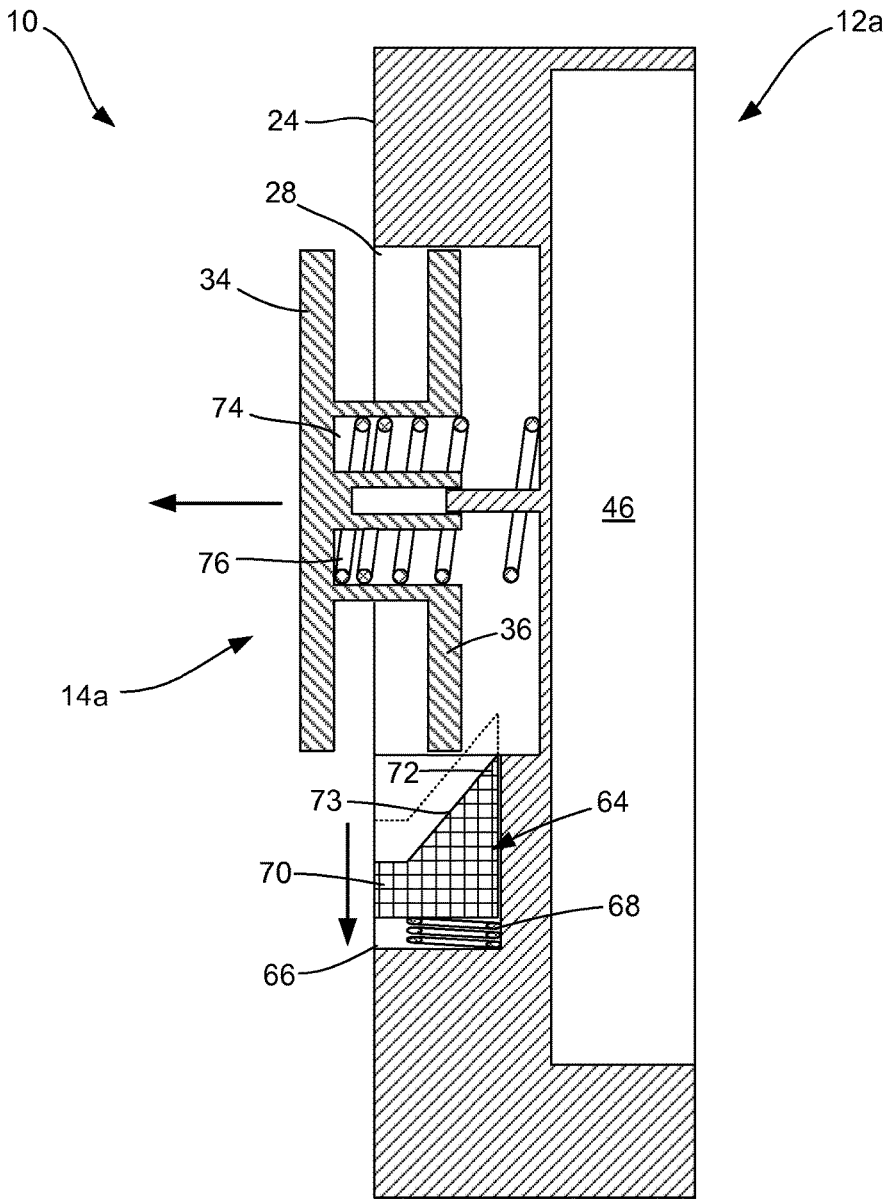

As previously described herein, an electronic device case consistent with the present disclosure may further include a means of retaining the spool member 14 within the rear cavity 28 of the case member 12. FIGS. 7, 8A and 8B illustrate one embodiment of a means for retaining the spool member within the rear cavity of the case member.

Referring to FIG. 7, a rear view of an electronic device case 10 in an assembled state is illustrated; specifically showing a finger retainer mechanism 62 configured to be coupled to and retain the spool member 14*a* within the rear cavity 28 of the case member 12*a*. As generally understood, the case member 12*a* and spool member 14*a* may be similar to the case member 12 and spool member 14 shown in FIGS. 1-6, and, as such, like numerals represent like parts.

As shown, the finger retainer mechanism 62 generally includes a finger retainer member 64 positioned within a channel 66 defined on the rear portion 24 of the case member. The finger retainer mechanism 62 further includes a spring 68 positioned between the finger retainer member 64 and a wall of the channel 66 to provide a biasing force against finger retainer member 64. As described in greater detail herein, the finger retainer member 64 is configured to move from a first position and a second position along a length of the channel 66, as indicated by the bidirectional arrow. When in the first position, as illustrated in FIGS. 7 and 8A, the finger retainer member 64 is engaged with a portion of the spool member 14*a* and is configured to retain the spool member 14*a* within the rear cavity 28. When in the second position, as illustrated in FIG. 8B, the finger retainer member 64 is disengaged from the spool member 14*a*, thereby allowing disassembly of the electronic device case 10, wherein the spool member 14*a* may be removed from the rear cavity 28, providing a user access to the spool member 14*a* and the headphones 54.

FIGS. 8A and 8B are sectional views of the electronic device case 10 of FIG. 7 taken along line 8-8 illustrating assembled and disassembled states. Referring to FIG. 8A, the finger retainer member 64 is shown in the first position (hereinafter referred to as "engaged position"). As shown, finger retainer member 64 generally includes a raised portion 70 extending at an incline towards a retaining portion 72. As generally understood, the raised portion 70 is configured to provide a user with a means of moving the finger retainer member 64 into and out of engagement with the spool member 14*a*. As shown, the channel 66 is positioned adjacent to and generally intersects with the rear cavity 28 of the case member 12. When in an engaged position, the spring 68 generally applies a biasing force against the finger retainer member 64 in a direction towards the rear cavity 28, such that a retaining portion 72 of the finger retainer member 72 extends from the channel 66 into the rear cavity 28 and further engages a portion of the spool member 14*a*, specifically the second flange member 36. While in the engaged position, the finger retainer member 64 is configured to retain the spool member 14*a* within the rear cavity 28. In the event that the user desires to gain access to the spool member 14*a*, the user need only move the finger retainer member 64, by way of the raised portion 70 for example, from the engaged position to the second position (hereinafter referred to as "disengaged position"), as shown in FIG. 8B and described in greater detail herein.

Furthermore, the spool member 14*a* may be spring-loaded. In particular, as shown, the spool member 14*a* includes an internal cavity 74 defined between a portion of the hub 38 and the bore 40. A spring 76 is positioned within the internal cavity 74, such that, when in an assembled state, as shown in FIG. 8A, the spring 76 is configured to apply a biasing force against the spool member 14*a* and the internal surface of the rear cavity 28. Upon disengagement of the finger retainer member 64 from the spool member 14*a* (i.e. the finger retainer member 64 moves from the engaged position to the disengaged position), the force from the spring 76 is configured to direct the spool member 14*a* out of and away from the rear cavity 28 (as shown in FIG. 8B). It should be noted that the spool member 14*a* may include other known components configured to provide a biasing force. For example, the spool member 14*a* may include bands, magnets, air-driven force, electrically-drive force, or combinations thereof to provide the biasing force between the spool member 14*a* and rear cavity 28.

Referring to FIG. 8B, the finger retainer member 64 is shown moving from the engaged position to the disengaged position, as indicated by the arrow, wherein the retaining portion 72 moves out of contact with the second flange member 36 of the spool member 14*a*. In turn, the biasing force applied to the spool member 14*a* by the spring 76 results in the spool member 14*a* moving in a direction away from the rear cavity 28, as indicated by the arrow, essentially popping out of the rear cavity 28. It should be noted that the spool member 14*a* and case member 12*a* may be configured such that, when the spool member 14*a* pops out of the rear cavity 28, only a portion of the spool member 14*a* may transition out of the rear cavity 28. For example, the spool member 14*a* and/or case member 12*a* may be configured to allow only the first flange member 34 and hub 38 of the spool member 14*a* to move out of the rear cavity 28 and retain the second flange member 36 within the rear cavity 28, thereby providing a user with access to at least the hub 38 for winding of the headphone cord 56 around the hub 38.

In one embodiment, both ends of the spring 76, for example, may be fixed to the spool member 14*a* and case member 12*a* and configured to apply a force sufficient to move only the first flange member 34 and hub 38 out of the rear cavity 28. In other embodiments, the spool member 14*a* and/or case member 12*a* may include other known means of restricting movement of the spool member 14*a* out of the rear cavity 28 and limiting exposure of only the first flange member 34 and hub 28. In certain instances, it may be desirable to have complete removal of the spool member 14*a*, such as when repair is necessary. As such, the spool member 14*a* and/or case member 12*a* may be configured to allow complete removal of the spool member 14*a* from the rear cavity 28.

After the finger retainer member 64 has been moved to the disengaged position, the finger retainer member 64 will return to an engaged position due to the constant biasing force applied thereto by the spring 68. The inclined portion 73 between the raised portion 70 and the retaining portion 72 of the finger retainer member 64 is shaped such that the spool member 14*a* may be repositioned within the rear cavity 28 and placed into a locked fashion with the finger retainer member 64. For example, as the second flange member 36 makes contact with the finger retainer member 64 as the spool member 14*a* is being positioned back into the rear cavity, the inclined portion 73 may transfer the force applied by the spool member 14*a* such that the finger retainer member 64 moves from and the engaged position to the disengaged position. Once the second flange member 36 is fully received within the rear cavity 28, the finger retainer member 64 may then slide back into the engaged position due to the biasing force of the spring 68, such that the retaining portion 72 engages the second flange member 36, as shown in FIG. 8A.

Figure 9:
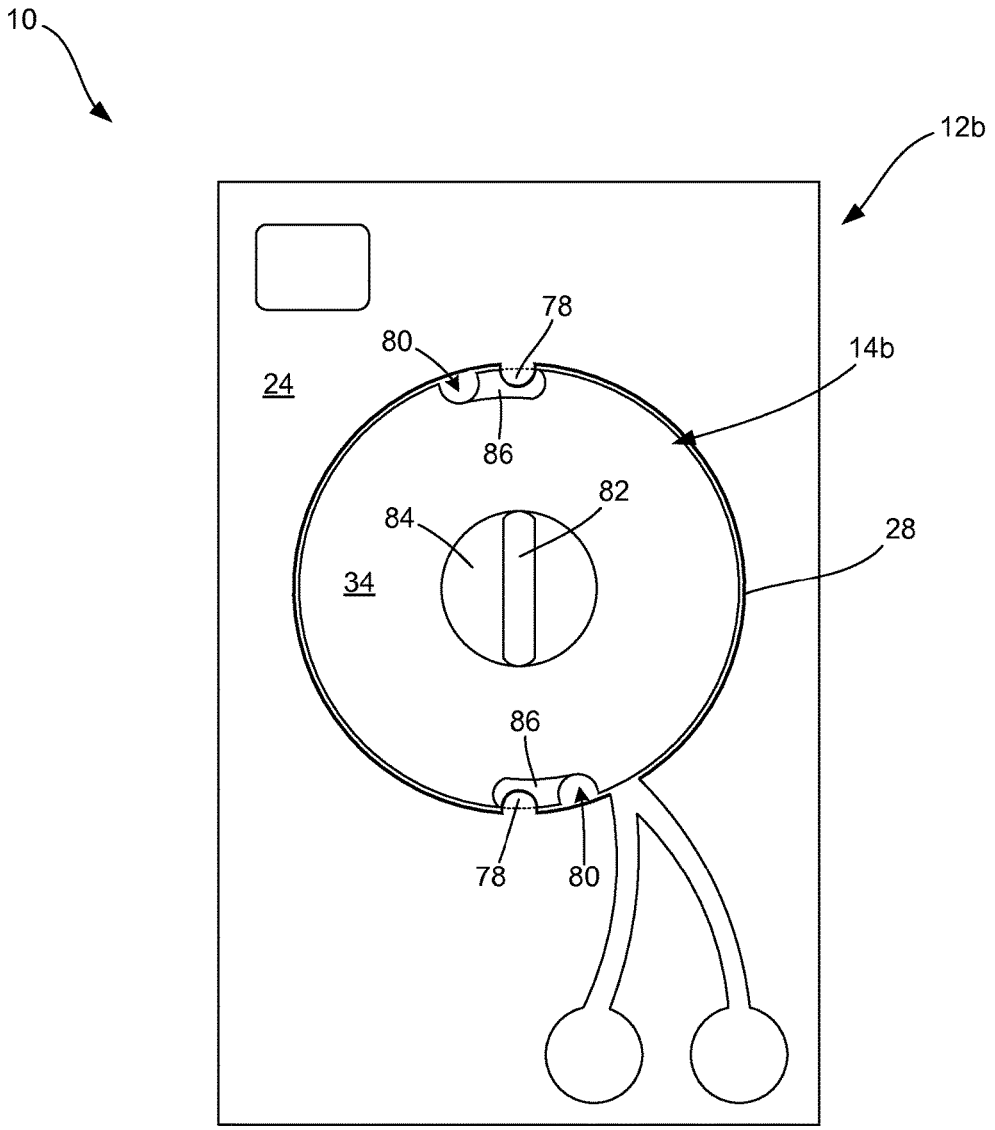
FIG. 9 is a rear view of an electronic device case in an assembled state including another embodiment of a means for coupling and retaining the spool member to the case member consistent with the present disclosure.
Figure 10:
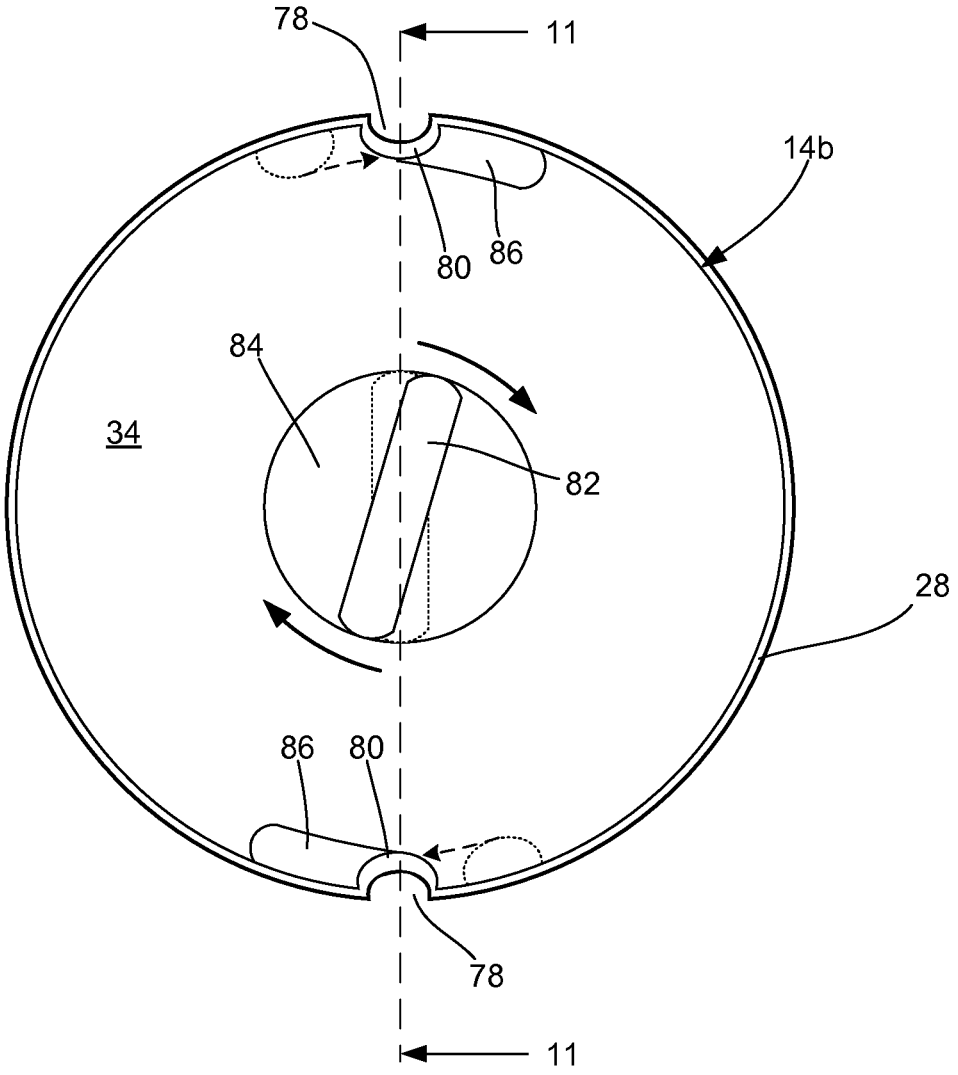
FIG. 10 is a rear view of the electronic device case of FIG. 9 illustrating the spool member transitioning from an engaged position to a disengaged position in relation to the case member.
Figure 11:
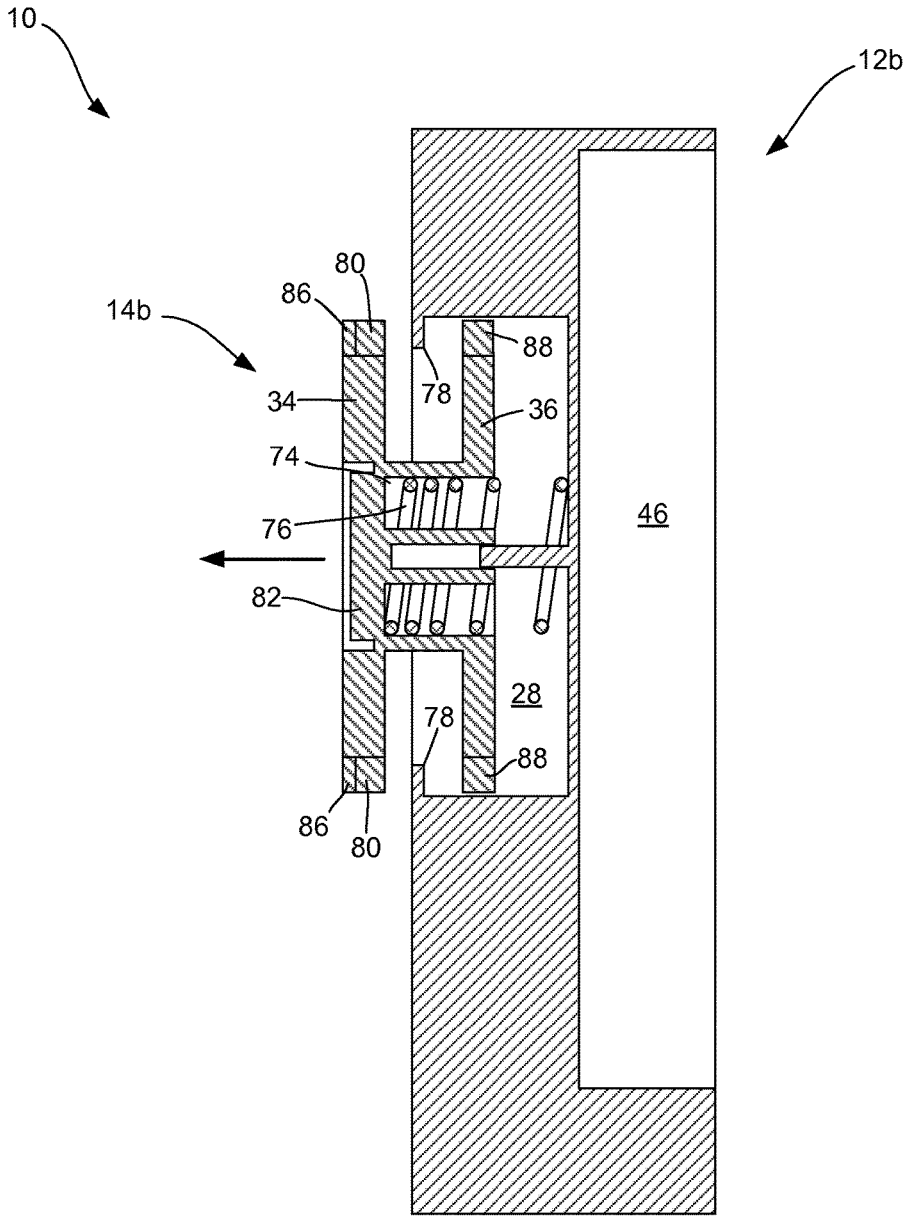
FIG. 11 is a sectional view of the electronic device case of FIG. 10 taken along line 11-11 illustrating the spool member separating from the case member.

FIGS. 9-11 illustrate another embodiment of a means for retaining the spool member within the rear cavity of the case member. Referring to FIG. 9, a rear view of an electronic device case 10 in an assembled state is illustrated. As shown, the case member 12*b* and spool member 14*b* are configured to be coupled to one another when the spool member 14*b* is positioned within the rear cavity 28 of the case member 12*b*. More specifically, the rear cavity 28 generally includes one or more retaining tabs 78 extending from a periphery of the rear cavity 28 at a surface of the rear portion 24. In the illustrated embodiment, the rear portion 24 includes two retaining tabs 78 defined on opposing sides of the rear cavity 28, wherein the retaining tabs 78 generally extend inwardly towards the center of the rear cavity 28. As generally understood, a case member consistent with the present disclosure may include any number of retaining tabs in a variety of different shapes, sizes, and positions along the periphery of the rear cavity.

As shown, at least the first flange member 34 of the spool member 14*b* includes openings 80 defined on an outer periphery thereof. The openings 80 correspond to the retaining tabs 78 in shape and/or size, such that a retaining tab 78 may pass through a corresponding opening 80. As described in greater detail herein, the retaining tabs 78 are configured to retain the spool member 14*b* within the rear cavity 28 when the spool member 14*b* is in a first position, as shown in FIG. 9. When in a first position, the retaining tabs 78 engage a portion of the first flange member 34, specifically recesses 86 coupled to openings 80 and extending along a length of the periphery of the first flange member 34. The retaining tabs 78 are configured to retain the spool member 14*b* within the rear cavity 28 of the case member 12*b* when the spool member is in the first position. When the spool member 14*b* is in a second position (shown in FIGS. 10 and 11), the openings 80 are aligned with corresponding retaining tabs 78 such that the retaining tabs 78 area disengaged from the recesses 86 of the first flange member 34 and the spool member 14*b* is able to be at least partially removed from within the rear cavity 28 as the retaining tabs 78 can pass through the openings 80. The spool member 14*b* further includes a handle portion 82 positioned within a depression 84 on a surface of the first flange member 34. The handle portion 82 is configured to allow a user to move the spool member 14*b* between the first and second positions.

FIG. 10 is a rear view of the electronic device case 10 of FIG. 9 illustrating the spool member 14*b* transitioning from the first position (hereinafter referred to as "engaged position") to the second position (hereinafter referred to as "disengaged position") in relation to the case member 12*b*. As shown, when the user desires to have access to the spool member 14*b*, the user need only rotate the spool member 14*b* between the engaged and disengaged positions, as indicated by the arrows. For example, when the user moves the spool member 14*b* in a clockwise direction, the retaining tabs 78 become disengaged from the recesses 86 along the outer periphery of the first flange member 34 until the openings 80 and retaining tabs 78 are aligned with one another, thereby placing the spool member 14*b* in a disengaged position, upon which at least a portion of the spool member 14*b* may move out of the rear cavity 28 and allow a user with access to headphone cord 56 wound around the hub 38 of the spool member 14*b*.

FIG. 11 is a sectional view of the electronic device case of FIG. 10 taken along line 11-11 illustrating the spool member 14*b* separating from the case member 12*b*. Similar to the embodiment shown in FIGS. 7, 8A and 8B, the spool member 14*b* may be spring-loaded. In particular, as shown, the spool member 14*b* includes an internal cavity 74 defined between a portion of the hub 38 and the bore 40. A spring 76 is positioned within the internal cavity 74, such that, when in an assembled state, as shown in FIG. 9, the spring 76 is configured to apply a biasing force against the spool member 14*b* and the internal surface of the rear cavity 28. Upon disengagement of the retaining tabs 80 from the recesses 86 of the first flange member 34 (i.e. the spool member 14*b* moves from the engaged position to the disengaged position), the force applied by spring 76 is configured to direct at least a portion of the spool member 14*b* out of and away from the rear cavity 28, as indicated by the arrow.

In the illustrated embodiment, the second flange member 36 may further include openings 88 defined along the outer periphery thereof. The openings 88 may further allow the retaining tabs 78 to pass therethrough, thereby allowing the spool member 14*b* to be positioned within the rear cavity 28 of the case member 12*b*. In one embodiment, the openings 88 may correspond to and be aligned with the openings 80 of the first flange member 34, such that, upon disengagement of the retaining tabs 80 from the recesses 86 of the first flange member 34 (i.e. the spool member 14*b* moves from the engaged position to the disengaged position), the retaining tabs 78 may pass through the openings 80, 88 of the first and second flange members 34, 36 as force applied by spring 76 directs the spool member 14*b* away from the rear cavity 28, wherein the entire spool member 14*b* may be completely removed from the rear cavity 28.

When a user would like to position the spool member 14*b* back into the rear cavity 28, the user need only align openings 80, 88 of the first and second flange members 34, 36, respectively, with the retaining tabs 78 and force the spool member 14*b* into the rear cavity 28, such that the retaining tabs 78 pass through the openings 80, 88. The user then need only to move the spool member 14*b* from the disengaged position to the engaged position by turning the spool member 14*b* in a counter-clockwise direction until the retaining tabs engage the recesses 86. As generally understood, movement of the spool member between the engaged and disengaged positions need not be limited to the clockwise and counter-clockwise directions, respectfully, and, in other embodiments, the movements may be reversed.

As previously described with regard to the spool member 14*a* and case member 12*a* of FIGS. 7 and 8A-8B, the spool member 14*b* and case member 14*b* may be configured such that, when the spool member 14*b* pops out of the rear cavity 28, only a portion of the spool member 14*b* may transition out of the rear cavity 28. For example, in another embodiment, the openings 88 of the second flange member 36 may be misaligned with the openings 80 of the first flange member 34, such that, when the spool member 14*b* is moved to the disengaged position, the retaining tabs 78 only pass through the openings 80 of the first flange member 34 and further engage a portion of the periphery of the second flange member 36, thereby preventing the spool member 14*b* from completely transitioning out of the rear cavity 28 and leaving only the first flange member 34 and the hub 38 of the spool member 14*b* exposed. Should the user wish to completely remove the spool member 14*b* from the rear cavity 28, the user need only rotate the spool member 14*b* until the openings 88 of the second flange member 36 are aligned with the retaining tabs 78, thereby allowing the retaining tabs 78 to pass therethrough and the spool member 14*b* to be completely removed. Additionally, or alternatively, both ends of the spring 76, for example, may be fixed to the spool member 14*b* and case member 12*b* and configured to apply a force sufficient to move only the first flange member 34 and hub 38 out of the rear cavity 28.

According to one aspect of the disclosure, there is thus provided a case for a portable electronic device. The case includes a case member including a front cavity configured to receive at least a portion of the electronic device, a rear cavity, at least one channel defined in a rear portion of the case member and in fluid communication with the rear cavity, and at least one recess defined in the rear portion of the case member and in fluid communication with the at least one channel; and a spool member configured to be received in the rear cavity of the case member. The spool member includes a first flange, and a second flange coupled to the first flange by a hub. When a cord of a corded accessory is wrapped around the hub between the first and second flange and the spool member is disposed in the rear cavity at least a portion of the cord may be disposed in the at least one channel defined in the rear portion of the case member and an earphone coupled to the end of the cord may be disposed in the at least one recess defined in the rear portion of the case member.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used. Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A case for a portable electronic device, the case comprising:

a case member comprising:

a front cavity configured to receive at least a portion of the electronic device, a rear cavity opposite the front cavity, the rear cavity having an open end and a closed end, at least one channel defined in a rear portion of the case member and in fluid communication with the rear cavity, and at least one recess defined in the rear portion of the case member and in fluid communication with the at least one channel; and a spool member configured to be received in the rear cavity of the case member, wherein, when the spool member is received within the rear cavity, the spool member is configured to transition between a first spool position and a second spool position, when the spool member is in the first spool position, at least a portion of the spool member extends through the open end of the rear cavity and, when the spool member is in the second spool position, the spool member extends from the closed end at least partially to the open end of the rear cavity, the spool member comprising:

a first flange, and a second flange coupled to the first flange by a hub, wherein when a cord of a corded accessory is wrapped around the hub between the first and second flange and the spool member is disposed in the rear cavity at least a portion of the cord may be disposed in the at least one channel defined in the rear portion of the case member and an earphone coupled to the end of the cord may be disposed in the at least one recess defined in the rear portion of the case member, wherein, when the cord of the corded accessory is wrapped around the hub between the first and second flange and the spool member is in the second spool position, the first flange and a rear portion of the case member form a substantially planar surface.

2. A case for a portable electronic device according to claim 1, wherein the at least one channel comprises a first channel and a second channel and the at least one recess comprises a first recess in fluid communication with the first channel and a second recess in fluid communication with the second recess, and when the cord of the corded accessory is wrapped around the hub between the first and second flange and the spool member is disposed in the rear cavity a first portion of the cord may be disposed in the first channel and a first earphone coupled to an end of the first portion of the cord may be disposed in the first recess and a second portion of the cord may be disposed in the second channel and a second earphone coupled to an end of the second portion of the cord may be disposed in the second recess.

3. A case for a portable electronic device according to claim 1, wherein the case member is configured to releasably retain the spool member in the rear cavity.

4. A case for a portable electronic device according to claim 3, the device further comprising a spring for biasing the spool member outwardly from the rear cavity.

5. A case for a portable electronic device according to claim 1, wherein the case member further comprises a retainer member channel formed therein, and wherein the portable electronic device further comprises a finger retainer member disposed in the retainer member channel and movable within the retainer member channel between a first retainer position and a second retainer position, wherein when the retainer member is in the first retainer position the retainer member engages a portion of the spool member to retain the spool member in the rear cavity and, wherein, when the retainer member is in the second retainer position, the retainer member is disengaged from the spool member to allow the spool member to transition to the first spool position.

6. A case for a portable electronic device according to claim 5, the device further comprising a spring for biasing the retainer member toward the first retainer position.

7. A case for a portable electronic device according to claim 1, wherein the rear cavity comprises at least one retaining tab extending from a periphery thereof and wherein the first flange comprises at least one opening for receiving the at least one retaining tab, whereby, when the spool is in the second spool position, the retaining tab may extend through the at least one opening and may be positioned against a surface of the first flange to retain the spool in the second spool position.

8. A case for a portable electronic device according to claim 7, wherein the first flange comprises a recess coupled to the at least one opening for receiving the at least one retaining tab.

9. A case for a portable electronic device according to claim 7, wherein the second flange includes at least one opening for receiving the at least one retaining tab.

10. A case for a portable electronic device according to claim 9, wherein the at least one opening in the first flange is misaligned with the at least one opening of the second flange.

11. A case for a portable electronic device, the case comprising:

a case member comprising:

a front cavity configured to receive at least a portion of the electronic device, a rear cavity opposite the front cavity, the rear cavity having an open end and a closed end, at least one channel defined in a rear portion of the case member and in fluid communication with the rear cavity, and at least one recess defined in the rear portion of the case member and in fluid communication with the at least one channel; and a spool member configured to be received in the rear cavity of the case member, wherein, when the spool member is received within the rear cavity, the spool member is configured to transition between a first spool position and a second spool position, when the spool member is in the first spool position, at least a portion of the spool member extends through the open end of the rear cavity and, when the spool member is in the second spool position, the spool member extends from the closed end at least partially to the open end of the rear cavity, the spool member comprising:

a first flange, and a second flange coupled to the first flange by a hub, wherein when a cord of a corded accessory is wrapped around the hub between the first and second flange and the spool member is disposed in the rear cavity at least a portion of the cord may be disposed in the at least one channel defined in the rear portion of the case member and an earphone coupled to the end of the cord may be disposed in the at least one recess defined in the rear portion of the case member, wherein the case member further comprises a retainer member channel formed therein, and wherein the portable electronic device further comprises a finger retainer member disposed in the retainer member channel and movable within the retainer member channel between a first retainer position and a second retainer position, wherein when the retainer member is in the first retainer position the retainer member engages a portion of the spool member to retain the spool member in the rear cavity and, wherein, when the retainer member is in the second retainer position, the retainer member is disengaged from the spool member to allow the spool member to transition to the first spool position.

12. A case for a portable electronic device according to claim 11, the device further comprising a spring for biasing the retainer member toward the first retainer position.

13. A case for a portable electronic device, the case comprising:

a case member comprising:

a front cavity configured to receive at least a portion of the electronic device, a rear cavity opposite the front cavity, the rear cavity having an open end and a closed end, at least one channel defined in a rear portion of the case member and in fluid communication with the rear cavity, and at least one recess defined in the rear portion of the case member and in fluid communication with the at least one channel; and a spool member configured to be received in the rear cavity of the case member, wherein, when the spool member is received within the rear cavity, the spool member is configured to transition between a first spool position and a second spool position, when the spool member is in the first spool position, at least a portion of the spool member extends through the open end of the rear cavity and, when the spool member is in the second spool position, the spool member extends from the closed end at least partially to the open end of the rear cavity, the spool member comprising:

a first flange, and a second flange coupled to the first flange by a hub, wherein when a cord of a corded accessory is wrapped around the hub between the first and second flange and the spool member is disposed in the rear cavity at least a portion of the cord may be disposed in the at least one channel defined in the rear portion of the case member and an earphone coupled to the end of the cord may be disposed in the at least one recess defined in the rear portion of the case member, wherein the rear cavity comprises at least one retaining tab extending from a periphery thereof and wherein the first flange comprises at least one opening for receiving the at least one retaining tab, whereby, when the spool is in the second spool position, the retaining tab may extend through the at least one opening and may be positioned against a surface of the first flange to retain the spool in the second spool position.

14. A case for a portable electronic device according to claim 13, wherein the first flange comprises a recess coupled to the at least one opening for receiving the at least one retaining tab.

15. A case for a portable electronic device according to claim 13, wherein the second flange includes at least one opening for receiving the at least one retaining tab.

16. A case for a portable electronic device according to claim 15, wherein the at least one opening in the first flange is misaligned with the at least one opening of the second flange.

* * * * *